United States Patent [19]

Svoboda et al.

[11] Patent Number: 4,785,979

[45] Date of Patent: Nov. 22, 1988

[54] FLOW CONTROL NOZZLE FOR BOTTOM-POUR LADLES

[75] Inventors: John M. Svoboda, Arlington Heights; Raymond W. Monroe, Prospect Heights, both of Ill.

[73] Assignee: Casteel Technology Associates, Ltd., Des Plaines, Ill.

[21] Appl. No.: 78,782

[22] Filed: Jul. 28, 1987

[51] Int. Cl.[4] ..... B22D 41/08

[52] U.S. Cl. ..... 222/591; 164/437

[58] Field of Search ..... 222/591, 606, 607; 266/236; 164/437, 337; 239/590, 590.5

[56] References Cited

U.S. PATENT DOCUMENTS

| | | | |
|---|---|---|---|
| 2,098,937 | 11/1937 | Brinkmann | 222/591 |
| 4,079,868 | 3/1978 | Moniot | 222/591 |

FOREIGN PATENT DOCUMENTS

| | | | |
|---|---|---|---|
| 672448 | 3/1966 | Belgium | 222/591 |
| 1294452 | 4/1962 | France | 222/591 |
| 343767 | 1/1966 | U.S.S.R. | 222/591 |
| 1159118 | 7/1969 | United Kingdom | 222/591 |

*Primary Examiner*—Joseph J. Rolla
*Assistant Examiner*—Nils E. Pedersen

[57] ABSTRACT

A flow control nozzle for bottom-pour ladles having a castellated entry and cruciform exit to inhibit the break up of an exiting liquid metal stream from a bottom-pour ladle while using a conventional stopper-rod to control the flow of the liquid metal stream to a mold. The nozzle is formed of a fused silica, sintered calcia or other appropriate refractories to inhibit nozzle blockage.

5 Claims, 1 Drawing Sheet

LIQUID STEEL
LIQUID STEEL
10
12
14
16
18
20
22
24
26
28
30
31
32
34

FLOW CONTROL NOZZLE FOR BOTTOM-POUR LADLES

BACKGROUND OF INVENTION

Steel casting generally uses solidification of steel to form the rough shape of the final product. The liquid steel is poured into a prepared mold of bonded sand. The sand mold cavity forms the desired shape from the liquid steel, and as the steel cools and solidifies, the product is formed. The liquid steel is melted in a furnace and then transferred from the furnace to the mold via a ladle. A ladle, is typically a steel shell, shaped like a large cylinder and lined with a refractory to resist the high temperature of the liquid steel. Liquid steel can be poured over the top edge of the ladle in a manner analogus to a teapot or common pitcher. However, pouring large quantities of steel over the edge of the ladle is impractical. Bottom pouring ladles avoid dropping the steel from the lip of lip pour (or teapot) ladles and allows good control over the pouring operation and is therefore the pouring method of choice. In bottom-pour ladles, a valve is placed at the bottom to allow liquid metal to flow from the ladle to a mold positioned thereunder. The most common valve used in bottom pouring steel is a nozzle positioned in an aperture in the ladle bottom and kept closed by a stopper-rod that seals the nozzle opening.

The nozzle-stopper-rod combination is normally of simple design. The stopper-rod has a simple rounded end and is coupled to the ladle to enable the intermittent flow of liquid steel from the ladle to a mold or a series of molds. The rounded end of the rod is seated on a smooth sealing area above the entrance opening of the nozzle. Generally, the nozzle is of a simple shape that has a sealing or seating area for the rod and a simple circular exit hole. The stopper-rod is on an assembly which keeps it seated on the nozzle during normal operation but that can be lifted off of the seat to allow pouring. When the rod is lifted, the liquid steel is allowed to flow past the stopper-rod-nozzle seal area, through the exit hole of the nozzle and into the mold. However, in bottom-pour ladles, oxide particles formed in prior steel processing can attach to the nozzle sealing area, and thereby slow or even stop the flow of liquid steel through the nozzle.

When pouring liquid steel from the ladle, the liquid steel interacts with the air and can form additional oxide particles which may be detrimental in the final product. Conventional nozzle-stopper-rod combinations produce poor quality product as well as a poor quality exit stream of liquid steel in that the liquid steel entrains air and forms additional oxide particles. If the nozzle-stopper-rod combination is not fully opened, severe air entrainment and oxide formation results.

Conventional nozzles are made of clay bonded ganister or alumina graphite combinations. The oxides formed in prior steel processing are composed of strong oxide forming metals such as aluminum. Due to the thermodynamic properties of these materials, these oxide particles prefer to stick to the nozzle material rather than to remain in the liquid steel. The sticking of the existing oxide particles is the cause of nozzle blockage. Other refractory combinations of aggregate and binder avoid the sticking. Calcia nozzles have been used successfully to avoid nozzle blockage. The oxide particles of alumina form a liquid oxide layer when they attach to calcia thus preventing blockage. Nozzles made of silica also avoid the sticking of oxide particles by the formation of liquid oxide interaction layer.

Poor exit stream quality is common with conventional nozzle-stopper-rod systems. As the metal enters the nozzle area, the general turbulence and fluid flow characteristics impart horizontal and torsional velocity components to the exiting metal stream. The liquid metal moves across the ladle bottom toward the nozzle area and this is the origin of the horizontal component. The liquid metal begins to vortex in the nozzle area and this imparts a torsional component. The combination of the horizontal and torsional components causes the exiting metal stream to break-up during pouring. The exiting metal stream can be hollow or even umbrella shaped. This is particularly true when the nozzle-stopper-rod system is not completely open.

The existing flow control nozzles for bottom-pour ladles create defective castings, which increase the costs of the final product due to the costs of rectifying such defective castings. Our invention substantially reduces or eliminates the defective molds poured by means of bottom-pour ladles having conventional nozzle-stopper-rod systems.

Our invention incorporates a nozzle having a geometry that is designed to avoid the break-up of the exiting metal stream and still allow the use of the conventional stopper-rod. The entrance to the nozzle area has castellations which help to prevent the vortexing or torsional component of velocity. The seal area is identical to conventional nozzles to allow the use of the conventional stopper-rod. The exit of the nozzle is a tapered cross shaped section, a cruciform, that dampens the torsional and horizontal components of velocity. This results in a good quality exit stream of liquid metal when pouring and avoids nozzle blockage and/or clogging.

BRIEF SUMMARY OF INVENTION

It is an object of the present invention to provide a flow control nozzle for a bottom-pour ladle that substantially reduces or eliminates defective castings caused by oxide particles passing to the mold via the nozzle.

It is another object of our invention to provide a nozzle that reduces blockage and improves the exit stream of liquid steel from the bottom-pour ladle to the mold.

It is still another object of the invention to provide a flow control nozzle for bottom-pour ladles having a geometry to avoid the break-up of exiting liquid metal from the ladle to the mold.

It is still another object of the invention to provide a nozzle in which the entrance end thereof has castellations that inhibit the vortexing or torsional component of the flowing liquid steel.

It is still another object of the invention to provide a nozzle in which the exit end thereof has a tapered cross shaped section, a cruciform, that dampens the torsional and horizontal components of velocity of the liquid steel as it flows into the mold from the ladle.

It is still a further object of the invention to provide a nozzle composed of an aggregate that improves the quality of the liquid steel pouring stream exiting from a bottom-pour ladle.

It is still a further object of the invention to provide a flow control nozzle of refractory material that inhibits and avoids nozzle blockage and clogging.

IN THE DRAWINGS

DETAILED DESCRIPTION OF THE PREFERRED EMBODIMENT

Figures 1, 2, 3, 4:
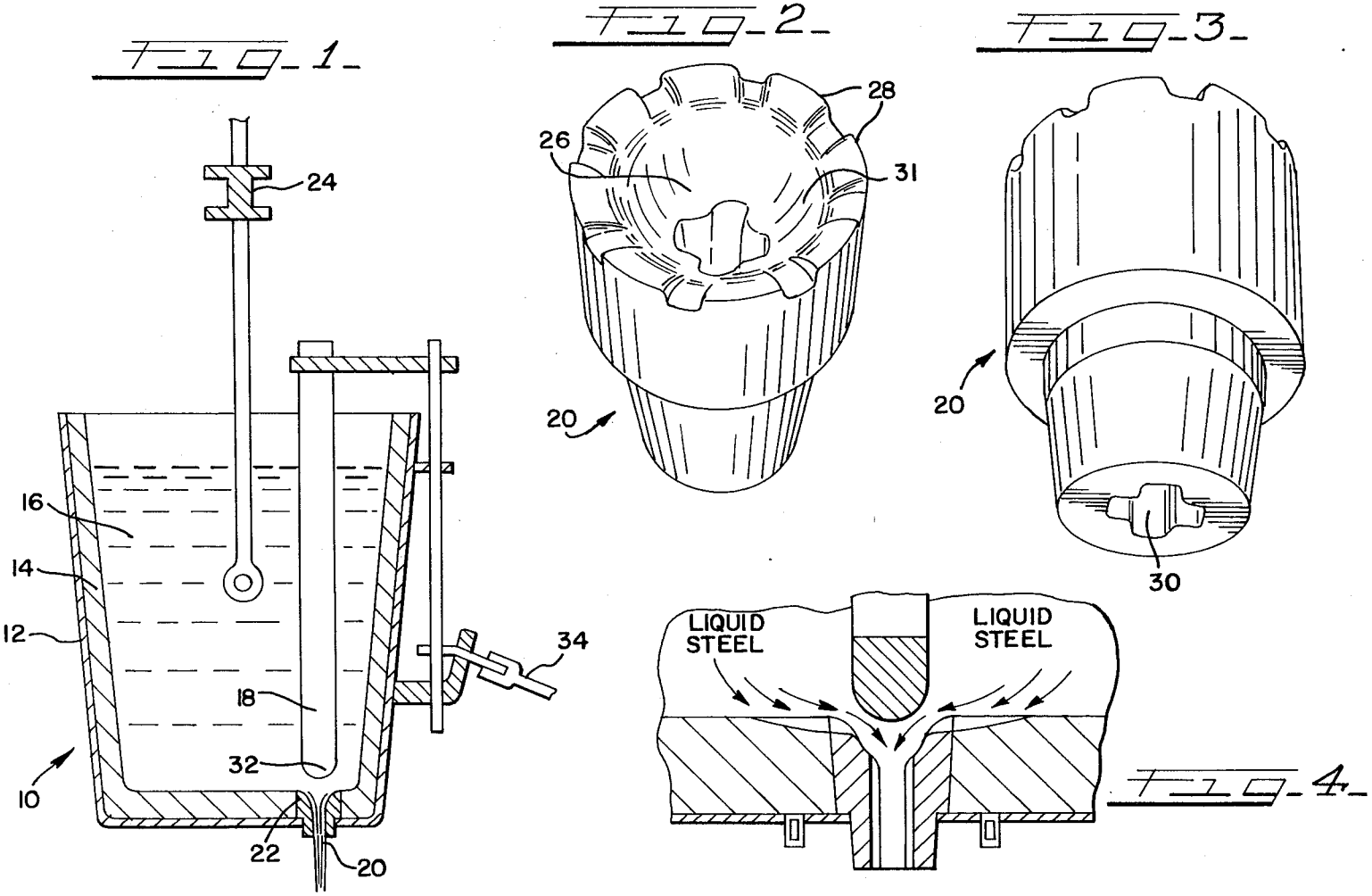
FIG. 1 illustrates a side cross-sectional view of a typical bottom-pour ladle.
FIG. 2 is a perspective top view of the entrance end of the flow control nozzle.
FIG. 3 is a perspective view of the exit end of the flow control nozzle.
FIG. 4 is a schematic representation of flow patterns of liquid steel around a bottom-pour ladle.

The present invention relates to a flow control nozzle for bottom-pour ladles and more particularly is directed to a flow control nozzle wherein the entrance end of the nozzle is castellated and the exit end is of a tapered cross or cruciform shape.

FIG. 1 illustrates a side-cross-sectional view of a typical bottom-pour ladle 10. The ladle 10 is comprised of a solid steel shell 12, a refractory lining 14 coupled to said shell, suitable for receiving liquid metal 16 without decomposing, a stopper-rod 18 coupled to the shell 12 by means well-known in the art and a pouring nozzle 20 positioned in an opening 22 at the bottom of the ladle 10. A lifting bail 24 is for positioning the ladle 10 over a mold, not illustrated, and is coupled to the ladle 10 by means well-known in the art.

The nozzle 20 has an entrance aperture 26 having castellations 28 that inhibit the vortexing or torsional component of velocity of the liquid metal 16 as it enters the nozzle. The upper end of the castellations are positioned to be flush with the inner bottom surface of the ladle. An exit aperture 30 of the nozzle 10 is of a tapered cross shaped section or cruciform that dampens the torsional and horizontal components of the velocity of the liquid metal 16. A tapered path 31 is provided from the castellated entrance 26 to the cruciform exit 30 enabling the liquid steel to flow from the ladle through the nozzle. The castellated entrance 26 and cruciform exit 30 of the nozzle 20 in combination with the tapered path 31 inhibit the break-up of the liquid metal 16 as it flows from the ladle to the mold. FIG. 4 is a schematic representation of a typical flow pattern of liquid steel around a bottom-pour nozzle.

The stopper-rod 18 has an end 32 suitable for engaging the nozzle entrance aperture 26 thereby restraining the flow of liquid metal 16 to the mold via the nozzle 20. The stopper-rod 18 has a pouring handle 34 coupled thereto and to the ladle 10 by means well-known in the art, said handle being suitable for lifting the stopper-rod above the nozzle entrance aperture 26 and reseating said rod into the nozzle entrance. The stopper-rod design is used for intermittent flow of the liquid metal from a bottom-pour ladle into a mold as distinguished from continuous flow ladles.

The nozzle is formed of a one piece refractory such as fused silica, magnesia, alumina, zircon or other such type refractory materials. We have found that refractory materials such as fused silica and sintered calcia inhibit the blockage of the nozzle entrance aperture 26; this also inhibits the flow of oxide particles from the ladle 10 to the mold via the nozzle 20.

The castellated entrance 26 and cruciform exit 30 of the nozzle 20 in combination with a suitable refractory such as silica or calcia inhibits the break-up of the exiting liquid metal improving the exit stream of liquid metal 16 into the mold while allowing the use of the conventional stopper-rod 18. This combination eliminates or substantially reduces the formation of oxide particles which in turn produces a mold having no defects or substantially reduced defects. In addition, the reduction or elimination of oxide particles substantially reduces the chance that the nozzle area will become sealed or almost sealed reducing or totally cutting off the flow of liquid metal.

It is to be understood that the above described nozzle is simply illustrative of the application of principles of our invention and many other modifications, including the use of other refractory material may be made without departing from the spirit and scope of the invention.

We claim:

1. A flow control nozzle for bottom-pour ladles to control the flow of liquid steel from the ladel to a steel casting mold, said ladle being formed of a steel shell having a refractory lining, an aperture at the bottom of the ladle for receiving and positioning therein the nozzle and a stopper-rod coupled to said ladle, said nozzle comprising:

a castellated entrance positioned in the aperture of the ladle wherein the top of the castellated entrance is flush with the inner surface of the ladle, said castellated entrance being suitable for receiving the stopper-rod to inhibit the flow of liquid steel through the nozzle;

a cruciform shaped exit positioned outside of the ladle; and a tapered path positioned between and separating the castellated entrance and the cruciform exit.

2. A flow control nozzle for bottom-pour ladles as defined in claim 1 wherein said nozzle is formed of a one piece refractory material.

3. A flow control nozzle for bottom-pour ladles as defined in claim 2 wherein said refractory material is fused silica.

4. A flow control nozzle for bottom-pour ladles as defined in claim 2 wherein said refractory material is magnesia.

5. A flow control nozzle for bottom-pour ladles as defied in claim 2 wherein said refractory material is sintered calcia.

* * * * *